US011078765B2

(12) United States Patent
Davis et al.

(10) Patent No.: US 11,078,765 B2
(45) Date of Patent: Aug. 3, 2021

(54) INTEGRATED PERFORATING GUN AND SETTING TOOL SYSTEM AND METHOD

(71) Applicant: GEODYNAMICS, INC., Millsap, TX (US)

(72) Inventors: Robert E. Davis, Joshua, TX (US); Terrell Saltarelli, Weatherford, TX (US); Jason Ansley, Bedford, TX (US)

(73) Assignee: GEODYNAMICS, INC., Millsap, TX (US)

( * ) Notice: Subject to any disclaimer, the term of this patent is extended or adjusted under 35 U.S.C. 154(b) by 129 days.

(21) Appl. No.: 16/437,144

(22) Filed: Jun. 11, 2019

(65) Prior Publication Data

US 2020/0332630 A1 Oct. 22, 2020

Related U.S. Application Data

(60) Provisional application No. 62/835,606, filed on Apr. 18, 2019.

(51) Int. Cl.

| | |
|---|---|
| ***E21B 43/1185*** | (2006.01) |
| ***E21B 43/116*** | (2006.01) |
| *E21B 23/06* | (2006.01) |
| *E21B 43/117* | (2006.01) |

(52) U.S. Cl.

CPC ..... *E21B 43/11855* (2013.01); *E21B 43/116* (2013.01); *E21B 43/1185* (2013.01); *E21B 23/065* (2013.01); *E21B 43/117* (2013.01)

(58) Field of Classification Search

CPC ..... E21B 43/11855; E21B 23/065; E21B 43/117; E21B 43/116; E21B 43/11; E21B 43/1185; E21B 47/017

See application file for complete search history.

(56) References Cited

U.S. PATENT DOCUMENTS

| | | | | |
|---|---|---|---|---|
| 9,194,219 | B1 * | 11/2015 | Hardesty | F42D 1/05 |
| 10,036,236 | B1 | 7/2018 | Sullivan et al. | |
| 2011/0024116 | A1 * | 2/2011 | McCann | E21B 43/1185 166/297 |
| 2017/0009560 | A1 | 1/2017 | Wells | |
| 2019/0162056 | A1 * | 5/2019 | Sansing | E21B 43/117 |
| 2019/0162057 | A1 | 5/2019 | Ashton et al. | |
| 2019/0212118 | A1 | 7/2019 | Saltarelli et al. | |
| 2019/0242205 | A1 | 8/2019 | Davis et al. | |
| 2019/0257181 | A1 * | 8/2019 | Langford | E21B 43/119 |

FOREIGN PATENT DOCUMENTS

| | | | |
|---|---|---|---|
| WO | 2017192878 | A1 | 11/2017 |
| WO | 2018170163 | A1 | 9/2018 |
| WO | 2019135804 | A1 | 7/2019 |

OTHER PUBLICATIONS

DynaStage User Guide 1.1, DynaEnergetics GmbH & Co. KG, Revised Jul. 20, 2017, pp. 1-53.

* cited by examiner

*Primary Examiner* — Michael R Wills, III

(74) *Attorney, Agent, or Firm* — Patent Portfolio Builders PLLC

(57) ABSTRACT

An interchangeable module is configured to be used in an integrated perforating gun and setting tool system. The interchangeable module includes a body having first external threads; an addressable switch located inside the body; and a connection unit located inside the body and configured to electrically connect to an initiating device. The interchangeable module is configured to be used (1) between a first gun cluster and a second gun cluster and (2) between a distal gun cluster and a setting tool.

32 Claims, 18 Drawing Sheets

INTEGRATED PERFORATING GUN AND SETTING TOOL SYSTEM AND METHOD

BACKGROUND

Technical Field

Embodiments of the subject matter disclosed herein generally relate to downhole tools for perforating operations, and more specifically, to a perforating gun and setting tool system that uses an interchangeable module for attaching two gun clusters to each other or a gun cluster to a setting tool, and the interchangeable module is configured to host either one of an ignitor or a detonator.

Discussion of the Background

To explore the oil and/or gas reservoirs located underground, it is necessary to drill a well 100 to a desired depth H relative to the surface 110, as illustrated in FIG. 1. Then, a casing 102 is installed in the well to protecting the wellbore 104. The casing 102 is cemented in place to isolate the casing from various formations located underground. However, these steps in effect create a barrier (the casing and the cement) between the oil reservoir or subterranean formation 106 and the wellbore 104. Thus, various downhole tools, like perforating guns and a setting tool, need to be lowered into the well and perforate the casing and the cement to establish a direct fluid communication between the wellbore and the subterranean formation.

Thus, the process of connecting the wellbore to the subterranean formation may include the following steps: (1) placing a plug 112 with a through port 114 (known as a frac plug) above a just stimulated stage 116, and (2) perforating a new stage above the plug 112. To place the plug 112, a setting tool 118, which is attached to a gun cluster 120, is used. The setting tool 118 is originally attached to the plug 112. After the gun cluster and the setting tool are lowered to a desired depth, the setting tool 118 needs to be activated to set the plug 112. To activate the setting tool 118, an ignitor (not shown) is ignited. Then, the gun cluster and the setting tool are moved upwards, at another stage that needs to be perforated. The step of perforating is achieved with the gun cluster 120. The gun cluster 120 is attached to a wireline 122, which is used to move the gun cluster to the desired position and also to activate corresponding detonators in the gun cluster. A controller 124 located at the surface 110 controls the speed of the wireline 122 and also sends various commands along the wireline to actuate one or more guns of the gun cluster.

A traditional gun cluster 120 includes plural carriers 126 connected to each other by corresponding subs 128, as illustrated in FIG. 1. Each sub 128 includes a detonator 130 and a switch 132. The detonator 130 is not connected to the through line (a wire that extends from the surface to the last gun and transmits the actuation command to the charges) until the corresponding switch 132 is actuated. The corresponding switch 132 is actuated by the detonation of a downstream gun. When this happens, the detonator 130 becomes connected to the through line, and when a command from the surface actuates the detonator 130, the upstream gun is actuated.

The explosive materials in the detonator and guns are highly dangerous. Thus, the transport of these materials from the manufacturing location to the wellsite poses logistical and safety problems. For these reasons, many manufacturers ship the various components of the gun cluster unassembled, with the expectation that the gun cluster would be assembled at the well location. In addition, for actuating the setting tool 118, an ignitor needs to be attached to the system, between the last gun cluster and the setting tool. Note that an ignitor is different from a detonator, although both of them are designed to burn a chemical to generate energy. The ignitor is typically larger and more powerful than a detonator. In addition, the ignitor is designed to ignite a power charge while the detonator is designed to detonate a detonator cord. In other words, the igniter generates heat or flame for igniting an additional material while the detonator causes a shock (for example, pressure wave) for detonating the additional material. Thus, the two devices are not interchangeable and they need to be used for their intended location, i.e., the igniter is used with the setting tool and the detonator is used with a gun cluster.

In the field, the operator of the well, who needs to perforate the casing, has to assemble the setting tool, the ignitor, the gun clusters and the corresponding detonators in a certain order. All these elements are then connected to each other with corresponding tandem subs. Also, the operator needs to use different subs for connecting the gun clusters to each other and the setting tool to a corresponding gun cluster. All these specifics require the expertise of a highly trained operator for assembling the gun system in the field. In addition, all these components need to be available in the field. The time necessary to select these components and put them together to obtain the desired gun system is substantial, which is not desired for well exploration.

Thus, there is a need to provide a simpler approach to assemble gun systems, that uses fewer components, which are shorter and simpler to connect and reduce gun string overall length.

SUMMARY

According to an embodiment, there is an interchangeable module (250) configured to be used in an integrated perforating gun and setting tool system. The interchangeable module includes a body having first external threads; an addressable switch located inside the body; and a connection unit located inside the body and configured to electrically connect to an initiating device. The interchangeable module is configured to be used (1) between a first gun cluster and a second gun cluster and (2) between a distal gun cluster and a setting tool.

According to another embodiment, there is a tandem sub configured to be used in an integrated perforating gun and setting tool system. The tandem sub includes a cylindrical body having a bore; an interchangeable module having first threads that are threaded into the bore of the cylindrical body; and an initiating device located inside the interchangeable module. The cylindrical body is configured to attach with either end to a gun cluster and a setting tool of the integrated perforating gun and setting tool system, and the initiating device is configured to initiate either the gun cluster or the setting tool.

According to still another embodiment, there is a method for assembling an integrated perforating gun and setting tool system. The method includes attaching with threads a first module to a first tandem sub; attaching a first end of the first tandem sub to a setting tool; attaching a first gun cluster to a second end of the first tandem sub; attaching with threads a second module to a second tandem sub; attaching a first end of the second module to the first gun cluster; and attaching a second end of the second module to a second gun cluster. The first module is identical to the second module.

According to yet another embodiment, there is a module configured to be used in an integrated perforating gun and setting tool system. The module includes a body, an addressable switch located inside the body, and an ignitor located inside the body and electrically connected to the addressable switch.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to an integrated perforating gun and setting tool system having two gun clusters and one setting tool. However, the embodiments discussed herein are applicable to gun systems having more gun clusters.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 1:
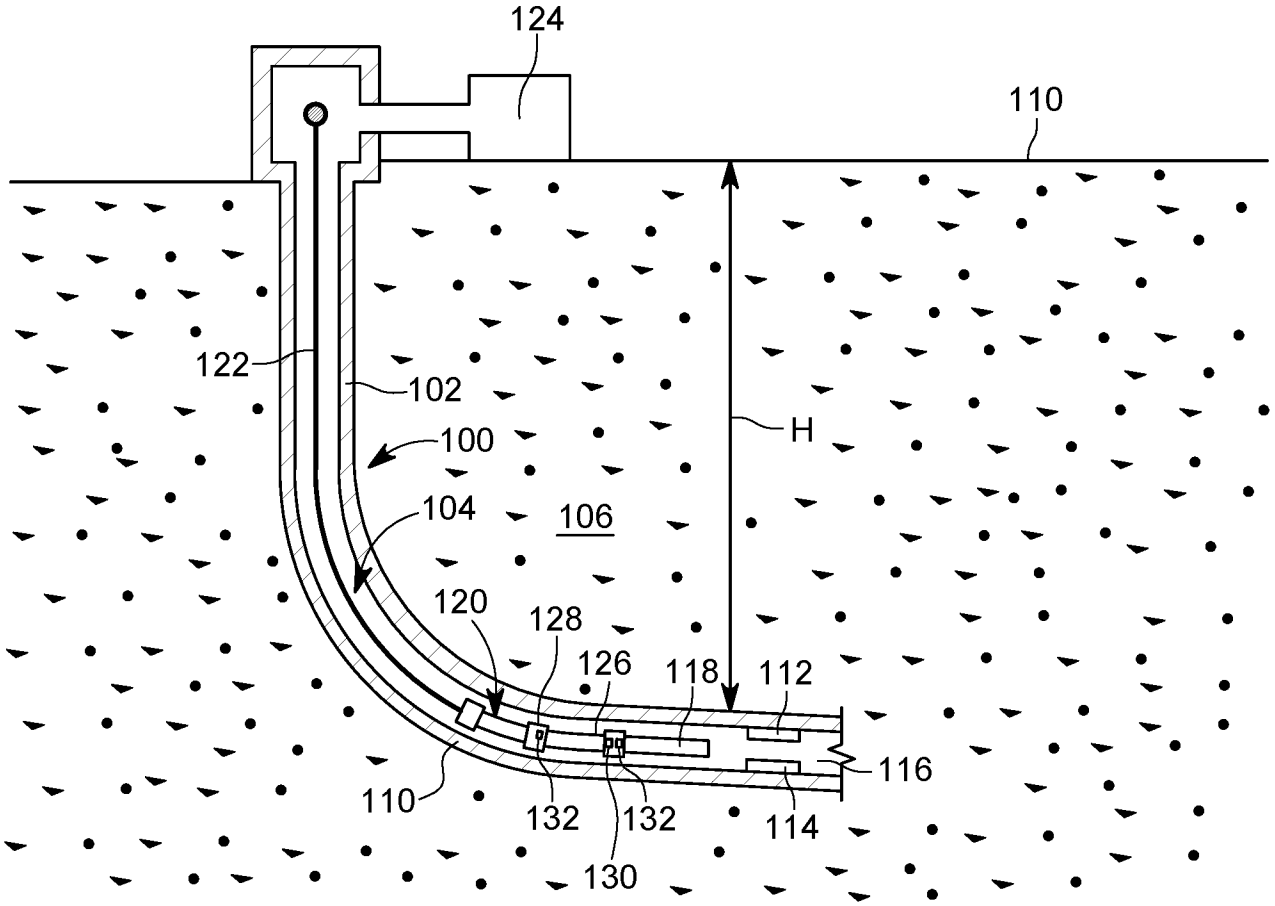
FIG. 1 (BACKGROUND ART)
FIG. 1 illustrates a well and associated equipment for well completion operations.
Figure 2:
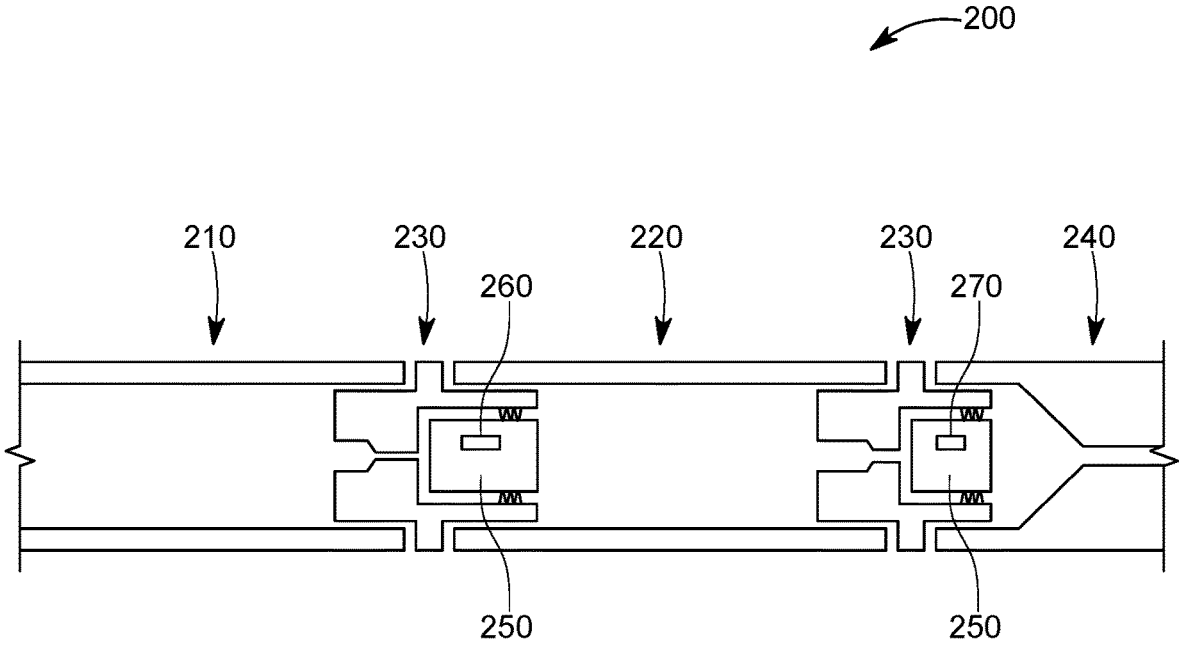
FIG. 2 illustrates an integrated perforating gun and setting tool system that uses a same interchangeable module for connecting a gun cluster to another gun cluster or a setting tool.

According to an embodiment illustrated in FIG. 2, an integrated perforating gun and setting tool system 200 includes first and second gun cluster 210 and 220 connected to each other by a tandem sub 230, and also a setting tool 240, connected to the second gun cluster 220 with a similar tandem sub 230. While FIG. 2 shows, for simplicity, only two gun clusters, one skilled in the art would understand that more than two gun clusters may be part of the integrated perforating gun and setting tool system. The tandem sub 230 can be used to connect any two gun clusters or any gun cluster and a setting tool. The tandem sub 230 is configured, as discussed later in more detail, to receive an interchangeable module 250 (herein a "module"). The module 250 is configured to hold a detonator 260, when used between two gun clusters, and to hold an ignitor 270, when used between a gun cluster and a setting tool. Thus, the same module 250 can be used anywhere along the integrated perforating gun and setting tool system. This simplifies the assembly of the system 200 as less parts are used for connecting the gun cluster and the setting tool and also prevents using the wrong type of module between the various components of the system.

The module 250 is designed to achieve electrical connections with the gun clusters and/or the setting tool by simply touching them, i.e., no electrical wires are attached to the module that need to be manually connected to corresponding wires of the setting tool and/or gun cluster. In one embodiment, the housing of the module has external threads that achieve the mechanical connection of the module to the tandem sub. In another embodiment, the detonator or ignitor can simply be inserted into the module to achieve mechanical and electrical connections, i.e., the module has female or male contacts that engage corresponding male or female contacts, respectively, of the detonator or ignitor, without the need to manually attached the contacts to each other. The features of the module 250 are now discussed in more detail.

Figure 3:
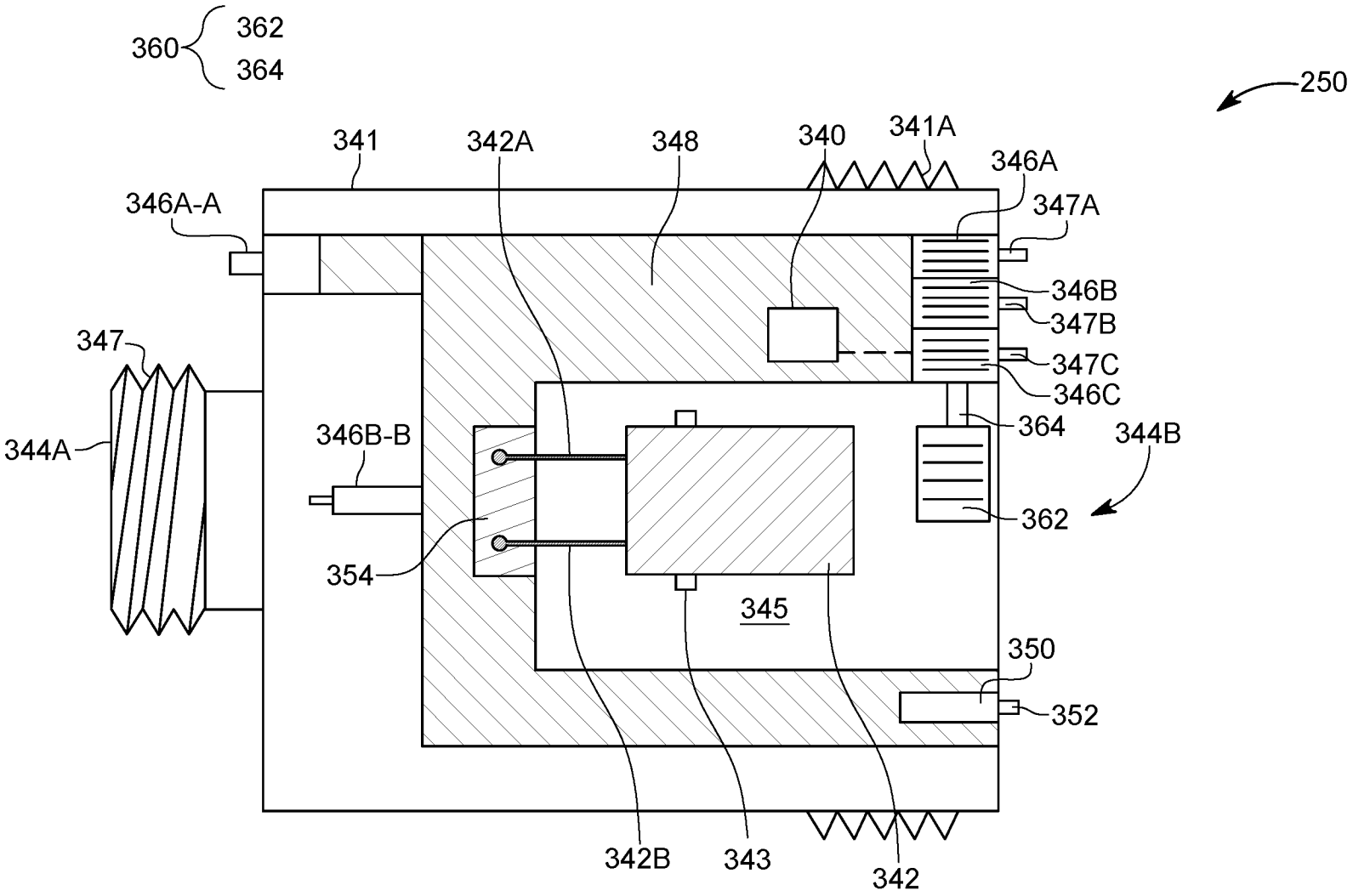
FIG. 3 illustrates an inside of the interchangeable module.

FIG. 3 shows a cross-section of the module 250 having an initiating device 342 (which may be the detonator 260 or the igniter 270) installed in a chamber 345 formed in a body 341 of the module 250. The initiating device 342 may be held in place by one or more holders 343 (e.g., off-the-self fuse holders). This means that any type of detonator or igniter may be placed inside the module 250. As discussed later, the chamber 345 may also house a printed circuit board 348.

In this embodiment, a first end 344A of the body 341 is narrower than the rest of the body and has threads 347 that are designed to mate with corresponding threads formed in the tandem sub 230 (shown in FIG. 2 and also disclosed in PCT Patent Application Serial No. PCT/US18/51868, entitled "Perforating Gun System and Method," the entire content of which is incorporated herein by reference). Note that a traditional sub has a switch retainer nut that holds in place a corresponding switch. The module 250 is configured in this embodiment to replace the switch retainer nut in the sub. This means that module 250 screws directly into the body of the tandem sub 230 when the gun assembly is assembled.

The second end 344B of the module 250 has a more complex structure. Plural spring-loaded contacts 346A to 346C (3 are shown in the figure but more or less contacts may be used in another embodiment) are attached to the printed circuit board (PCB) 348 and located so that corresponding pins 347A to 347C extend beyond the body 341. In one embodiment, these pins extend from the PCB 348, but they may extend only inside the body 341 of the module 250. The PCB 348 is placed inside the chamber 345 of the module. In one embodiment, the PCB 348 extends around the initiating device 342, in the same chamber 345, as shown in FIG. 3. The three spring-loaded contacts 364A to 346C connect to the through-wire, fire-wire and dedicated ground wire, respectively. However, note that when an addressable switch 340 is placed inside the body of the module, the fire-wire is not necessary, and thus, only two spring-loaded contacts are used, as discussed later with regard to FIGS. 6A to 6C. As will be discussed later, these three electrical contacts connect to corresponding contacts on a contact end plate mechanism of the gun cluster or setting tool. These connectors may be spring loaded to account for any variations in assembly which might otherwise prevent one of the connectors from making contact with a corresponding contact on the gun cluster or setting tool. In one application, the contact end plate mechanism may be spring loaded for achieving the same results.

A contact switch 350 may be located on the same PCB 348, and the contact switch is configured to shunt the leads 342A and 342B of the initiating device 342 when the tandem sub is not attached to the gun cluster or the setting tool. This is a safety feature which prevents an unwanted initiation of the initiating device. Note that the initiating device cannot be electrically actuated as long as its leads are shunted. In this regard, initiating device 342 has two leads 342A and 342B that are connected to a connection unit 354, which is attached to the PCB 348. While FIG. 3 shows the initiating device 342 being connected with wires to the connection unit 354, it is also possible to electrically connected the initiating device to the connection unit with no wires, for example, directly soldering the initiating device to the connection unit. The two leads 342A and 342B are shorted by the contact switch 350 when a head 352 of this switch is free, i.e., not in contact with anything. As soon as head 352, which can be made of plastic, is biased by the gun cluster or setting tool to which the module is attached, the two leads 342A and 342B are disconnected from each other. However, these leads remain connected to the rest of the circuit so that an initiating signal can be sent to the initiating device. Contact switch 350 may be a normally closed, momentary contact switch.

The PCB 348 electrically connects the ground contact 346A to a corresponding ground pin 346A-A and the through-line contact 346B to a corresponding through-line pin 346B-B. The through-line contact 346B corresponds to the line-in or line-out and the through-line pin 346B-B corresponds to the line-out or line-in. The switch contact 346C may be electrically connected to a corresponding switch in a downstream tandem sub and also to the wire connection unit 354 and to the contact switch 350. Pins 346A-A and 346B-B ensure that the ground-line and the through-line continue to the next gun cluster or setting tool.

The switch contact 346C may be electrically connected to an addressable switch 340 that is located on the PCB board 348. The addressable switch 340 may includes a processor $P_A$ (e.g., application-specific integrated circuit or field-programmable gate array or equivalent semiconductor device) that is electrically connected to the two leads 342A and 342B. For this embodiment, the contact switch 350 may be omitted as the addressable switch 340 prevents the initiating device 342 from an unwanted initiating. In other words, either the contact switch 350 or the addressable switch 340 may be used for ensuring the safe firing of the initiating device. However, in one embodiment, it is possible to have both switches as an extra safety measure. If the addressable switch 340 is present, then the initiating device 342 is initiated only when an initiating signal having the correct digital address of the addressable switch 340 is received from a global controller at the surface.

The digital address of the addressable switch 340 may be assigned in various ways. For example, it is possible that all the addressable switches of the gun system have a pre-assigned address. In one application, it is possible that the addressable switches have random addresses, i.e., addresses either assigned by the manufacturer of the memory or addresses that happen to be while the memories were manufactured. In still another embodiment, it is possible that a set of predetermined addresses were assigned by the manufacturer of the gun system. A more specific configuration of an addressable switch and how to use such an addressable switch may be found in PCT Patent Application Serial No. PCT/US18/22846, entitled "Addressable Switch Assembly for Wellbore Systems and Method," the entire content of which is incorporated herein by reference. However, other known addressable switches may be used for element 340.

The body 341 of the module 250 may have threads 341A on the outside, as shown in FIG. 3, and these threads are configured to mate with corresponding threads formed in the inside of the tandem sub 230. In this way, the module 250 can be fixedly attached to the interior of the tandem sub 230 with a simple rotational motion. If both threads 347 and 341A are present on the body 341, an even stronger connection is achieved between the module 250 and the tandem sub 230. If both the threads 347 and 341A are formed on the body 341, they need to have the same pitch and shape so that they simultaneously engage the corresponding threads from the tandem sub. Note that the module 250 can work with only one of the threads.

The module may further include another safety feature, an interrupter mechanism 360. The interrupter mechanism 360 includes, among other elements, a cap 362 and an arm 364. Cap 362 is placed to block a ballistic connection between the initiating device 342 and a detonation cord (not shown) in the adjacent gun cluster or a power charge in an adjacent setting tool. This means that even if the initiating device 342 is accidentally actuated while the tandem sub is not fully engaged with the gun cluster or setting tool, the produced pressure waves would not ignite the detonation cord inside the gun cluster or the power charge inside the setting tool, as the pressure waves would be blocked by the cap 362 and thus, the shaped charges of the gun are not actuated. Cap 362 may have the same or a larger diameter than the initiating device 342 for preventing the pressure waves from the initiating device to propagate downstream to the gun cluster or setting tool. Note that the module does not have to simultaneously have all the safety features discussed herein. The module may include at least one of these safety features. In one application, the module may include any combination of these safety features. In still another application, the module may have none of the safety features discussed herein if the addressable switch is used.

Figure 4:
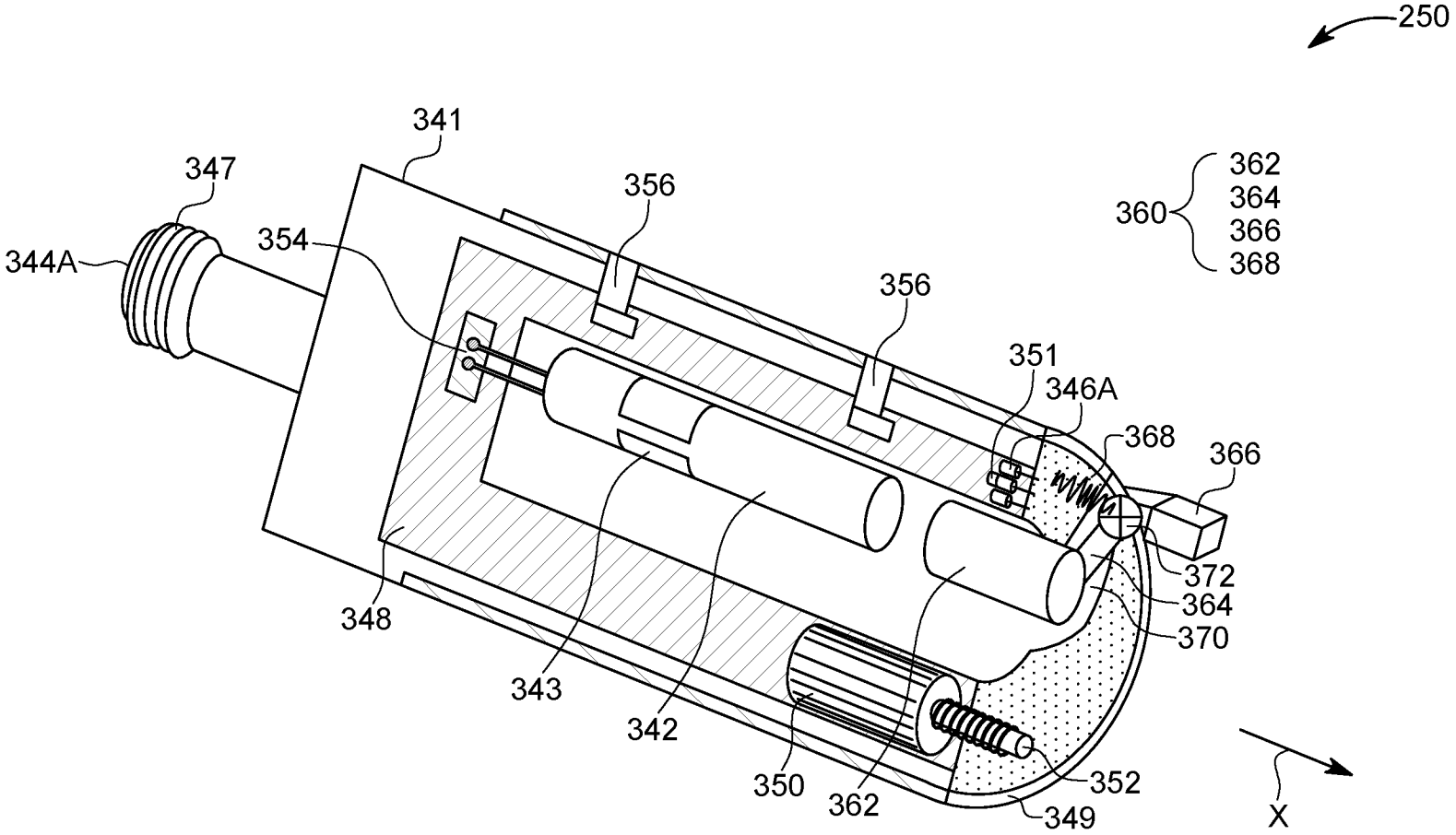
FIG. 4 illustrates various components of the interchangeable module.

FIG. 4 shows an overview of the module 250 that illustrates the interrupter mechanism 360. In this figure, an interrupter actuator 366 and an interrupter spring 368 are seen. Note that when the module 250 touches a contact end plate mechanism (see element 500 in FIG. 5) of a gun spring or setting tool in the system 200, the interrupter actuator 366 is pressed inside or along the module, along longitudinal axis X. This movement of the interrupter actuator 366 makes the interrupter spring 368 to swing upwards and thus, arm 364 rotates anti-clockwise. This anti-clockwise movement of the arm 364 makes the cap 362 to move to a side 370 of the interior of the body 341, ensuring ballistic contact (i.e., clear path) between the initiating device 342 and the detonator cord of the gun cluster (not shown) or the power charge of the setting tool (not shown). Arm 364 may be attached to the body 341 with a screw 372 or other equivalent mechanisms. The spring 368 pushes the actuator back when the module is not in contact with the contact end plate mechanism.

While the interrupter mechanism 360 shown in FIG. 4 is a mechanical device, it is possible to modify it to be an electronically controlled interrupter, which would be controlled by, for example, a processor of the addressable switch 340. Those skilled in the art would understand that the processor may be placed anywhere inside the body, and it may not be associated with the addressable switch 340. For this embodiment, the interrupter mechanism 360 may be modified to include a solenoid that would act on the arm 364 and/or cap 362 to open or close the ballistic connection between the initiating device and the downstream gun cluster or setting tool. In this embodiment, the processor sends an electrical signal to the solenoid when necessary to open the ballistic connection and no mechanical contact between the module and the gun cluster or setting tool is necessary.

FIG. 4 also shows two clamps 356 (more are possible) attached to the body 341. These clamps fit into corresponding mating members on the other half of the body 341. Thus, after the initiating device 342 and PCB 348 are placed inside one half of the body 341, the other half of the body 341 can be simply snapped in place. Those skilled in the art would understand that other means for connecting the two halves may be used, for example, screws. Also, it is possible that the body of the module 250 is made of more than two parts.

Another safety feature that may be added to the module is now discussed still with regard to FIG. 4. The PCB 348, when present, not only makes the electrical connections between the various elements of the module, but in one application it may also be used to form a Faraday cage to protect the initiating device 342 from electromagnetic interference. In this application, the entire back plane of the module may be made to be a ground plane. For example, a conductive foil 349 may be added to the exterior of the module, to act as the Faraday cage. The foil 349 may be added with an adhesive tape to the external side of the module. The foil needs to be positioned to not interfere with the movement of the interrupter mechanism.

Figure 5:
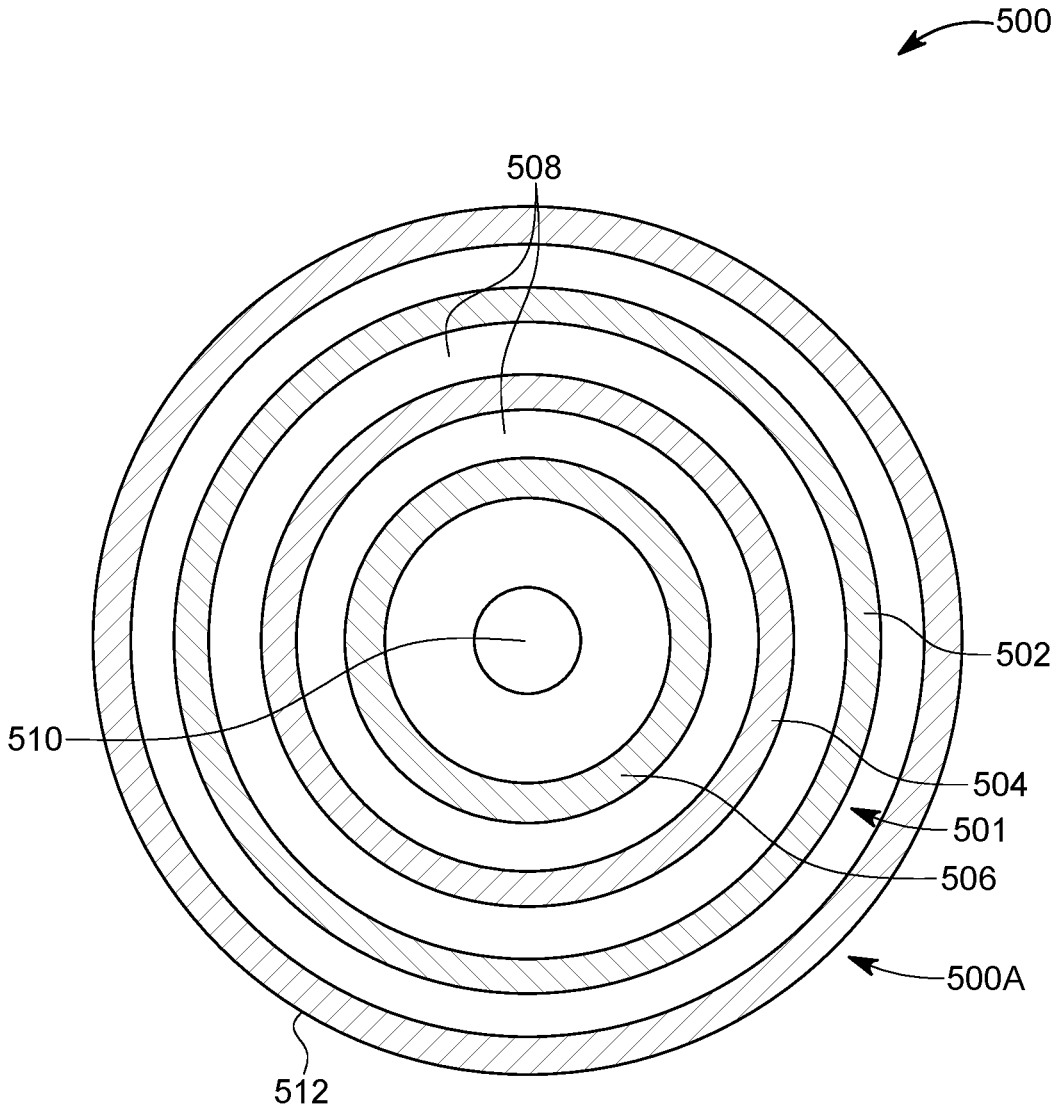
FIG. 5 illustrates a gun cluster plate connection for connecting to the interchangeable module.

The configuration of the contact end plate mechanism 500 noted above is now discussed with regard to FIG. 5. The contact end plate mechanism 500 needs to be present at an end of each of the gun cluster and the setting tool. Note that the contact end plate mechanism 500 takes the place of a conventional upstream endplate for a gun cluster. FIG. 5 shows a front face 500A of the contact end plate mechanism 500 and this front face electrically and mechanically connects to the module 250. For achieving the electrical connection with the module, the front face includes a printed circuit board 501 that has three electrical contacts (other number may be used in other applications) 502, 504 and 506, which are electrically separated from each other by insulating zones 508. The electrical contacts 502, 504 and 506 may be formed as rings on the printed circuit board. In one application, these electrical contacts may have another shape.

One skilled in the art would appreciate at least two advantages of these electrical contacts. First, the process of making these contacts (i.e., treating a printed circuit board to have three concentric rings) is easier and cheaper than stamping metal contacts as currently done in the industry. Second, the current gun systems require an accurate alignment of the various components for matching the electrical contacts of these various components. In the present embodiments, the three electrical contacts 346A, 346B and 346C of the module 250 (note that the module may have only two contacts or more than three) and the corresponding three electrical contacts 502, 504, and 506 of the contact end plate mechanism 500 do not need to exactly match each other because of the circular shape of the contacts 502, 504, and 506. In other words, the electrical contacts of the module may be rotated in any way relative to the longitudinal axis X of the module and they still contact the electrical contacts of the contact end plate mechanism 500. Further, even if there is a gap between the module and the contact end plate mechanism along the axis X, because of the springs biasing the pins of the electrical contacts of the module against the contact end plate mechanism, a good electrical contact is achieved between the module and the contact end plate mechanism. Thus, assembly of the module and the contact end plate mechanism is simplified as no precise alignment of the two parts is required.

The contact end plate mechanism 500 shown in FIG. 5 also has a central hole 510, through which the pressure waves from the initiating device 342 ballistically communicate with a detonator cord or power charge, which may be located behind the PCB front face 500A of the gun cluster or setting tool, respectively. FIG. 5 also shows a bracket 512 that maintains the PCB front face 500A attached to the contact end plate mechanism 500.

Figure 6A:
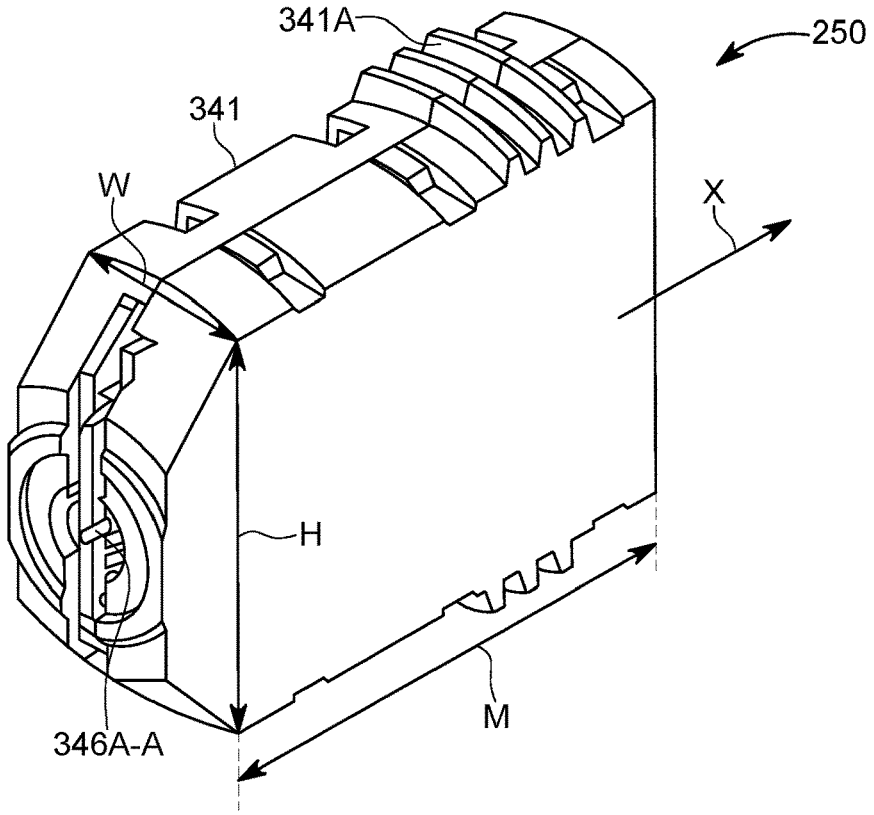
FIGS. 6A to 6D show various views of the interchangeable module.
Figure 6B:
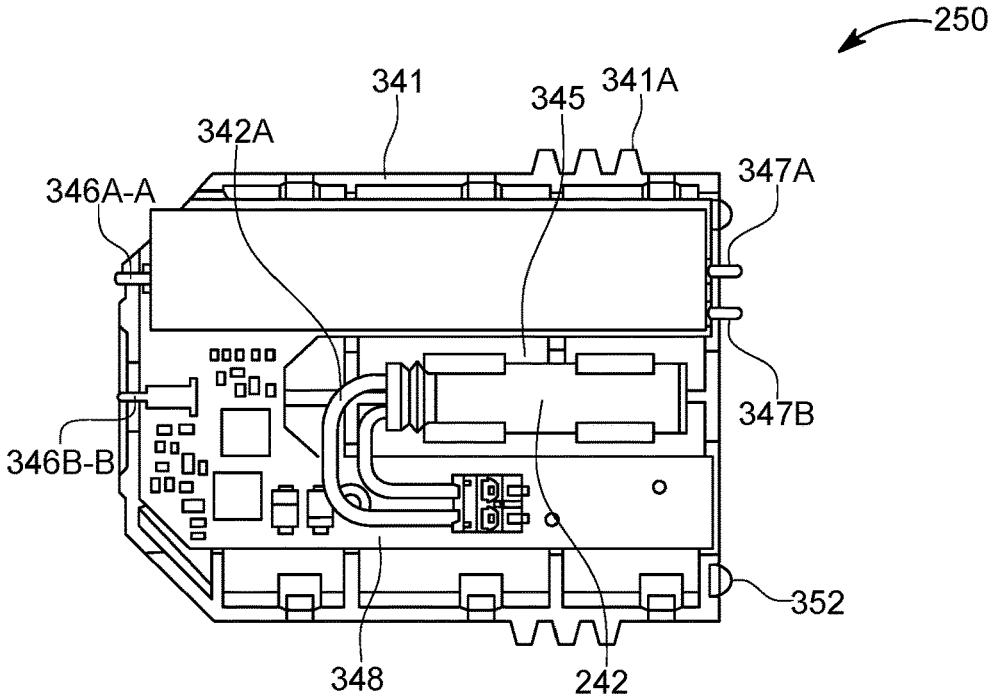
Figure 6C:
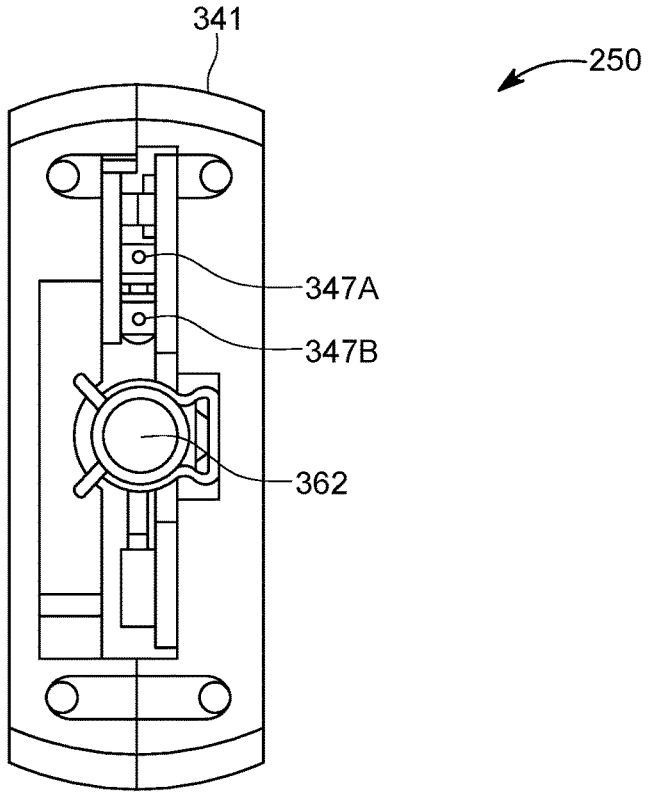
Figure 6D:
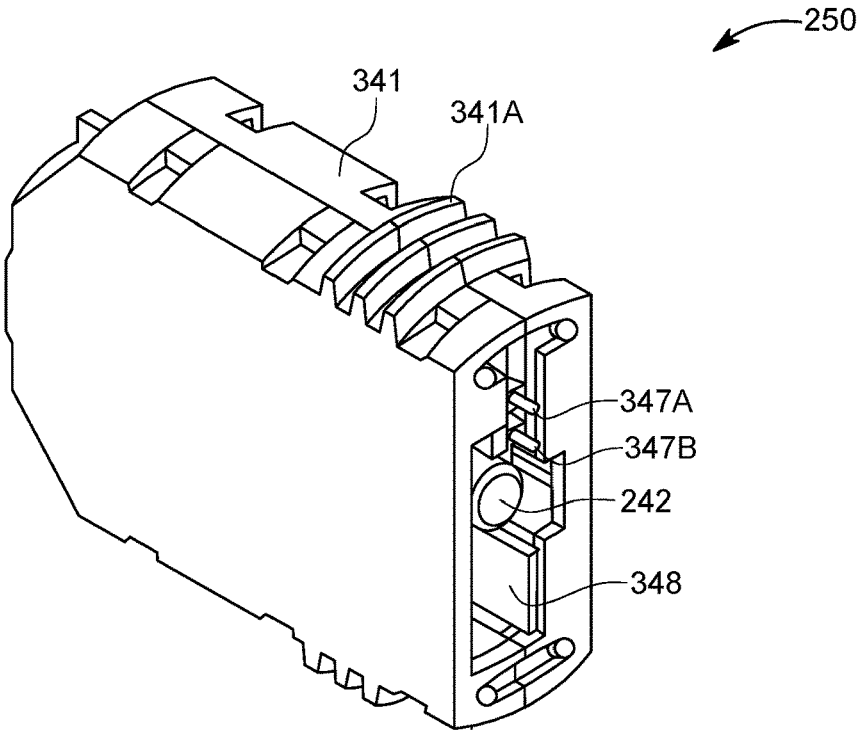

FIGS. 6A to 6D shows various views of the module 250. In this embodiment, the first end 344A of the housing 341 is missing, and thus, also the corresponding thread 347. This means that the module 250 may have or not these two elements. Only the thread 341A is used in this embodiment for attaching the module 250 to the tandem sub 230. Further, in this embodiment, only two pins 347A and 347B are used instead of three, as discussed in the embodiment of FIG. 3. These figures also show that the housing 341 may be implemented as two halves that are attached to each other when the module is ready to be attached to the tandem sub. In one embodiment, the housing 341 is shaped as a box, as also shown in FIGS. 6A to 6D. This means that the housing 341 has a length M, which extends along the longitudinal axis X of the gun assembly, a width W, and a height H. In one application, the length M is larger than either the width W or the height H. In still another application, as shown in FIG. 6A, the threads 341A are formed only on two sides of the housing 341, which correspond to the width W of the module. It is noted that no wires are exiting the housing 341, only the pins 347A and 347B at one end, and pins 346A-A and 346B-B at the opposite end. In one embodiment, one or more of these pins may be configured to be fully inside the housing 341, as shown, for example, in the embodiment of FIG. 3.

Figure 7:
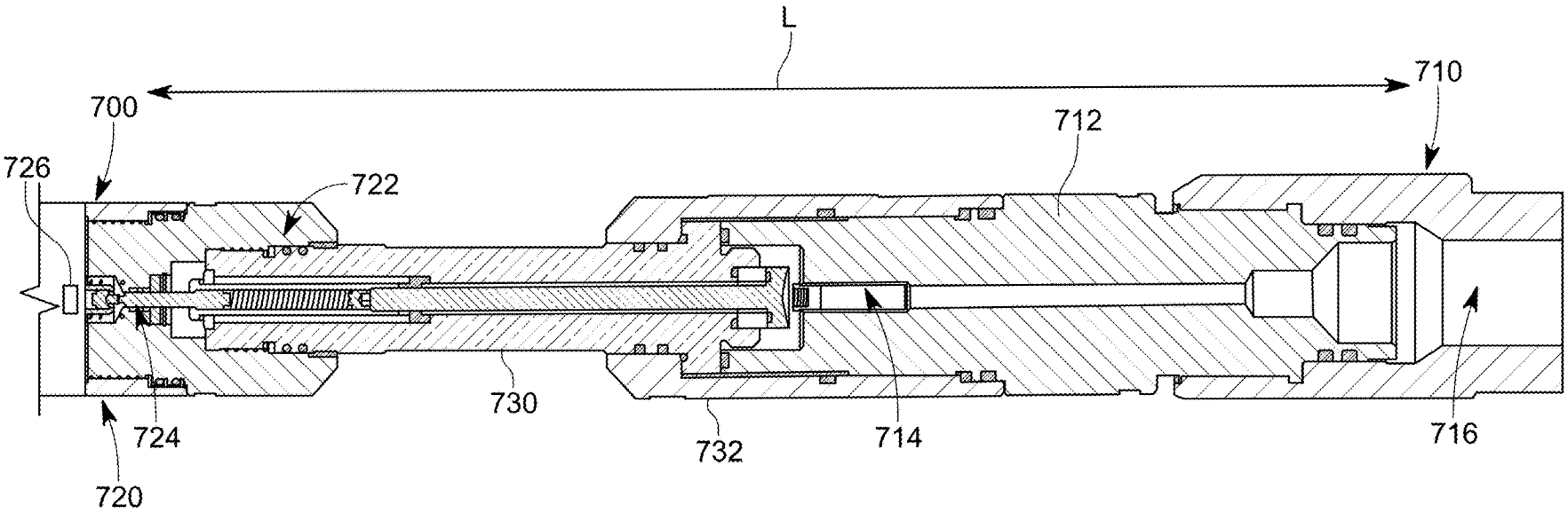
FIG. 7 (BACKGROUND ART)
FIG. 7 shows a gun cluster connected to a setting tool through a dedicated series of elements.

The placement of the module 250 at various locations along the integrated perforating gun and setting tool system 200 is now discussed in more detail. To appreciate the advantages brought by the module 250, FIG. 7 shows a typical system for coupling a perforating gun assembly 700 to a setting tool top sub 710. The perforating gun assembly 700 may include plural gun clusters 720. FIG. 7 shows only the last gun cluster 720, also called the bottom gun cluster, which couples to the setting tool top sub 710. A shoot-thru bull plug 722 is directly attached to the bottom gun cluster 720. A quick change mandrel 730 having a quick change collar 732 is directly connected to the shoot-thru bull plug 722. The quick change collar 732 directly connects to the setting tool firing head 712, which in turn directly connects to the setting tool top sub 710. FIG. 7 also shows the ignitor 714 being placed in the setting tool firing head 712. The ignitor 714 is electrically actuated through bottom feed-through contact 724, and the ignitor 714 ignites the power charge 716 placed in the setting tool top sub 710. It is noted the large length L of the elements connecting the last gun cluster 720 to the setting tool top sub 710, which is undesirable. Also, it is noted that a switch 726, located in the last gun cluster 720, and which is configured to actuate the ignitor 714, is placed far away from the ignitor. All these elements shown in FIG. 7 as being placed between the last gun cluster 720 and the setting tool top sub 710 cannot be used to connected one gun cluster to another gun cluster. For connecting those gun clusters to each other, another type of sub is necessary, with another switch and a corresponding detonator.

As previously discussed, having different connecting devices between two adjacent gun clusters and a gun cluster and the setting tool may confuse the operator of the gun, which may misconnect the electrical wires of these elements to each other, require the storage of many different components in the field, require a highly trained person to put together all these elements, and is time consuming.

Figure 8A:
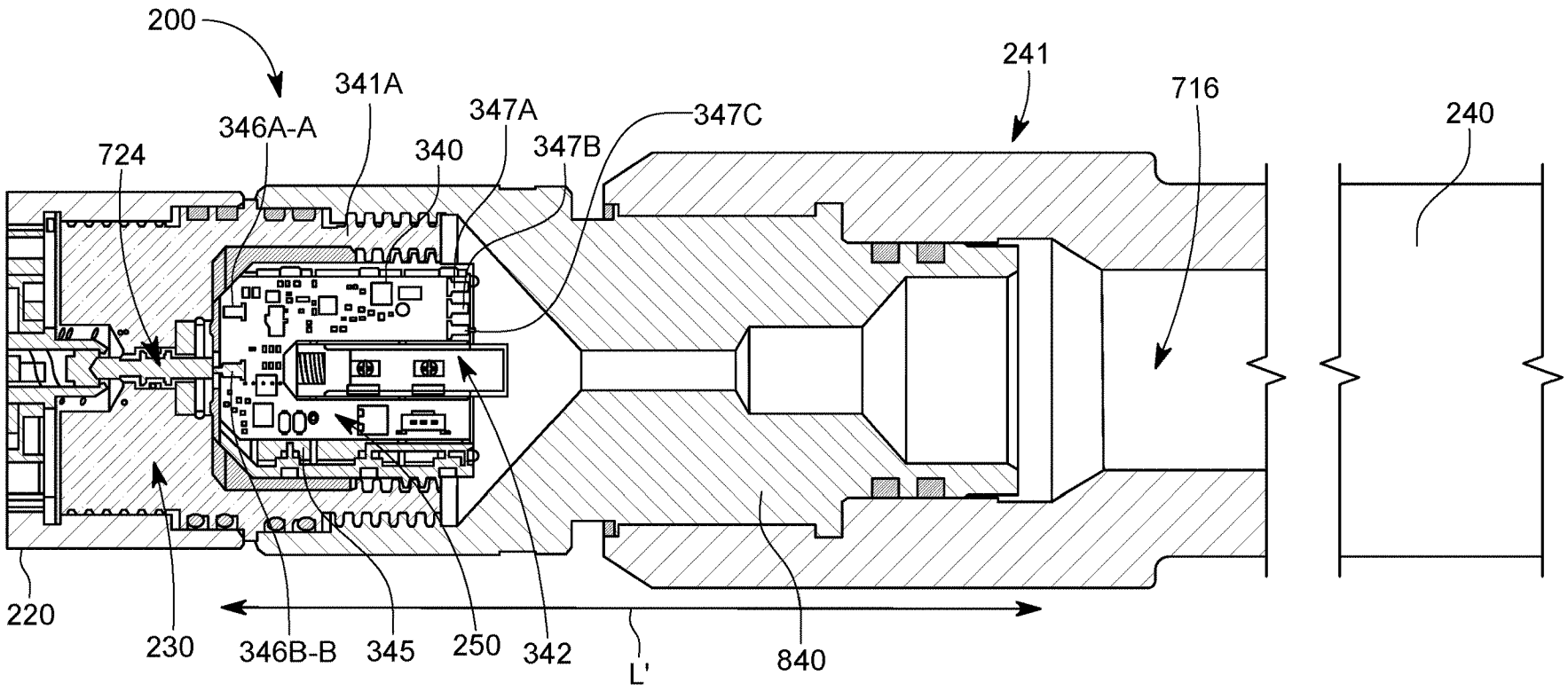
FIGS. 8A and 8B illustrate a single tandem sub that houses the interchangeable module and can be used to connect a gun cluster to another gun cluster or a setting tool.

One or more of these problems are overcame by using the interchangeable module 250 discussed with regard to FIG. 3 for connecting two gun clusters to each other or a gun cluster to a setting tool. FIG. 8A shows part of the integrated perforating gun and setting tool system 200 including the bottom gun cluster 220 connected through the tandem sub 230 and a plug-shoot adapter 840, to the top sub 241 of the setting tool 240. For simplicity, herein, the plug-shoot adapter 840 and the top sub 241 are considered to be part of the setting tool 240, and thus, these elements are sometimes referred to herein as the setting tool. The module 250 is placed inside the tandem sub 230. Note that a length L' between the bottom gun cluster 220 and the top sub 241 is much smaller than the length L in FIG. 7. The addressable switch 340 and the initiation device 342 are placed in the same cavity/chamber 345 inside the module 250 and the module 250 is placed inside the tandem sub 230. The tandem sub 230 has an extremely small length D that is visible from outside, when the gun cluster 220 is assembled with the top sub 241, as shown in FIG. 8B.

Note that in one example, the length D can be smaller than 5 cm. In still another embodiment, the length D is smaller than 1 cm. In still another embodiment, the length D that is visible from outside when the tandem sub 230 is attached to the bottom gun cluster 220 and the plug-shoot adaptor 840 is a couple of millimeters. FIG. 8B further shows that the module 250 can extend slightly outside the tandem sub 230, i.e., a portion 250A of the module 250 might extend into the plug-shoot adaptor 840, i.e., that portion 250A is not located inside the tandem sub 230.

Figure 8B:
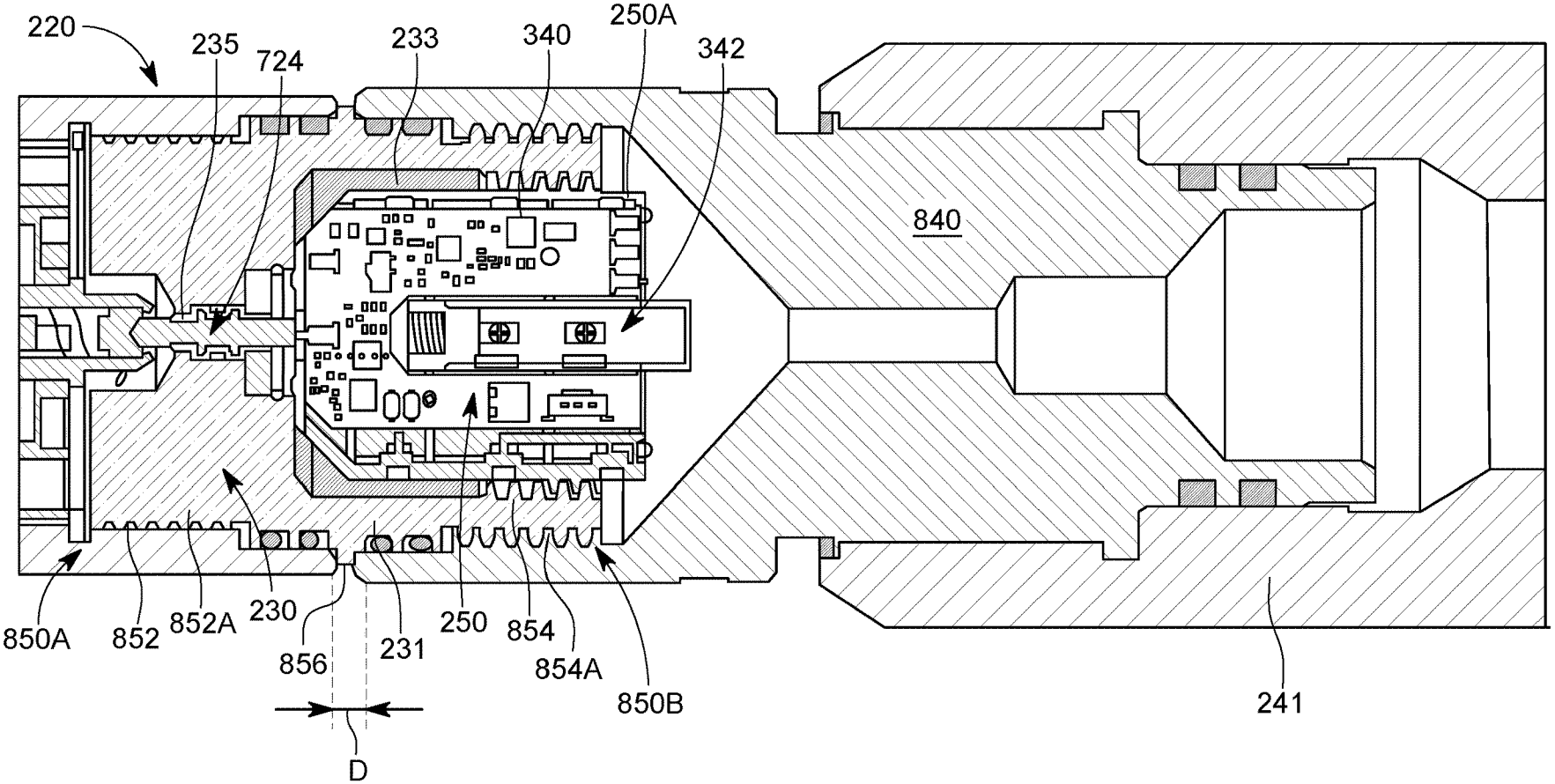

Returning to the tandem sub 230, it has a body 231 and a chamber or bore 233 formed in the body, as shown in FIG. 8B. The chamber 233 is large enough to accommodate the module 250. The chamber 233 fluidly communicates with a smaller bore 235 formed though the body 231, when the interior components are not present. However, a sealing bulkhead is placed inside the small bore 235 to prevent this fluid communication when the tandem is in use and all the other components are in place. The bottom feedthrough contact 724 is placed within the smaller bore 235. Note that the chamber 233 and the smaller bore 235 together extend through the entire body 231. The body 231 has a first end 850A and a second end 850B. A first region 852 is located at the first end and is configured to engage a gun cluster or setting tool. The first region 852 has threads 852A that are configured to engage corresponding threads of the gun cluster or setting tool. A second region 854 is located at the second end of the body 231, and is configured to engage another gun cluster or the setting tool. The second region 854 has threads 854A that are configured to engage corresponding threads of the gun cluster or setting tool. A third portion 856 of the body 231 is sandwiched between the first region 852 and the second region 854. Note that when the tandem sub 230 is fully engaged with the gun cluster 220 and the plug-shoot adapter 840, as illustrated in FIGS. 8A and 8B, only the third region 856 is visible from outside, while the first region 852 and the second region 854 are within the gun cluster and the setting tool, respectively.

Figure 9:
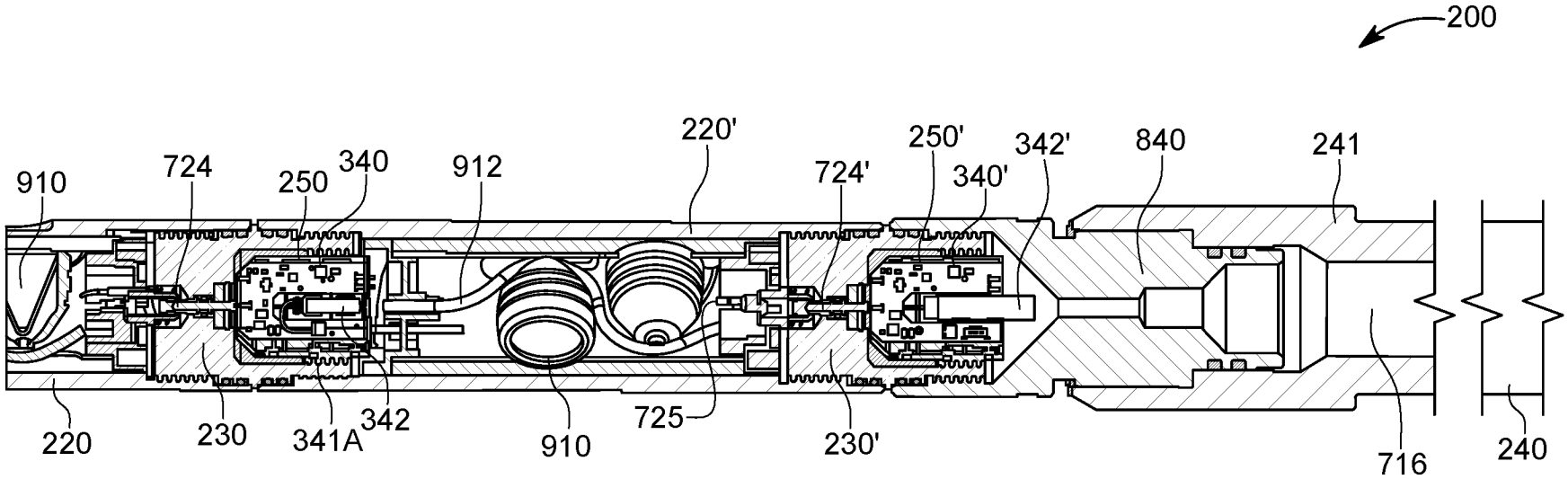
FIG. 9 illustrates an integrated perforating gun and setting tool system that uses a same interchangeable module to connect gun clusters and a setting tool.

FIG. 9 shows more details of the integrated perforating gun and setting tool system 200 and show identical modules 250 and 250' being used. The first module 250 is placed into a first tandem sub 230, which connects a first gun cluster 220 to a second gun cluster 220', and the second module 250' is placed into a second tandem 230', which connects the second gun cluster 220' to the plug-shoot adaptor 840 and then to the top sub 241 of the setting tool 240. Note that the prime symbol is used in this figure just to distinguish the first tandem sub from the second tandem sub (or gun cluster or module or initiating device), but the elements having the prime symbol are the same with the corresponding elements without the prime symbol. The only difference between the first module 250 and the second module 250' in FIG. 9 is that the first module 250 has an initiating device 342 that is a detonator, while the second module 250 has an initiating device 342' that is an ignitor.

Figure 10A:
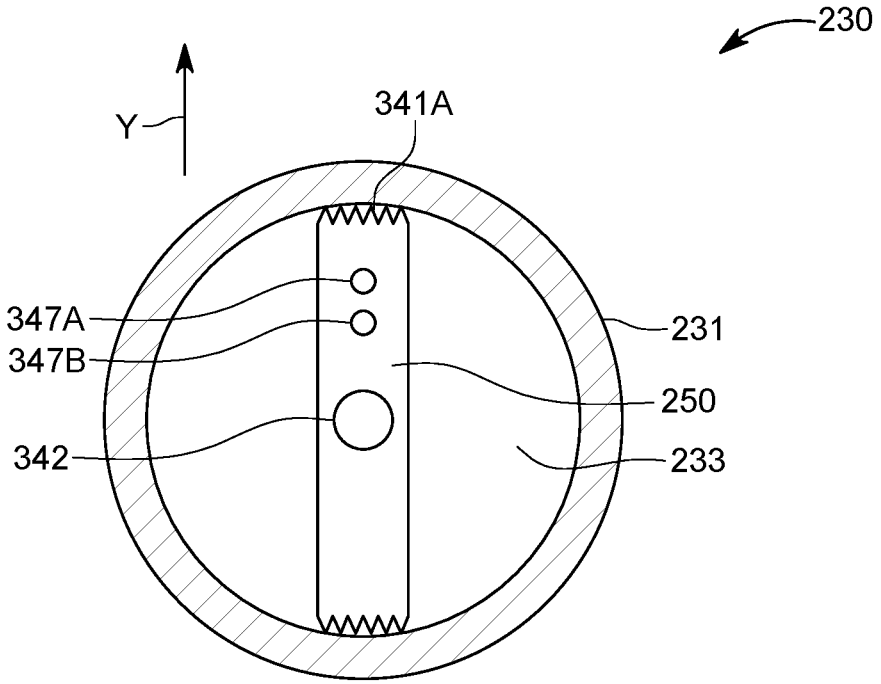
FIGS. 10A and 10B illustrate cross-section views of a tandem sub and a corresponding interchangeable module housed by the tandem sub.
Figure 10B:
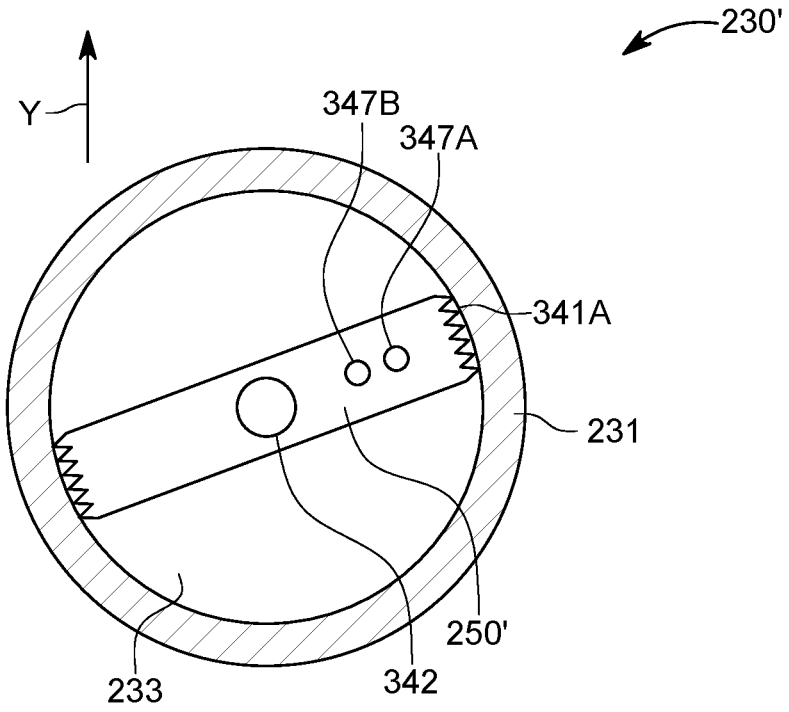

FIG. 9 shows some interior details of the second gun cluster 220', i.e., shaped charged 910, detonator cord 912, which is detonated by the detonator 342 in this case, and electrical conductors 725 that connect the bottom feed-through 724' of each gun cluster. FIG. 9 also shows how each module 250 is connected by threads 341A to the corresponding tandem sub 230. In this regard, because the module 250 is screwed into its corresponding tandem sub, as shown in FIGS. 10A and 10B, the final position of the module relative to the cylindrical body 231 of the corresponding tandem sub 230 may have any orientation. For example, FIG. 10A shows the module 250 being vertical (12 o'clock position) relative to a vertical axis Y while FIG. 10B shows the module 250 being inclined relative to the vertical axis Y (2 o'clock). In other words, any two modules 250 and 250' used in an integrated perforating gun and setting tool system 200 may have different angular orientations relative to a given axis (for example, the vertical) when assembled. There is no need that all the modules have the same angular orientation within their tandem sub. Note that FIGS. 10A and 10B also show the chamber 233 of the tandem sub in which the module 250 fits being partially empty.

Figure 11:
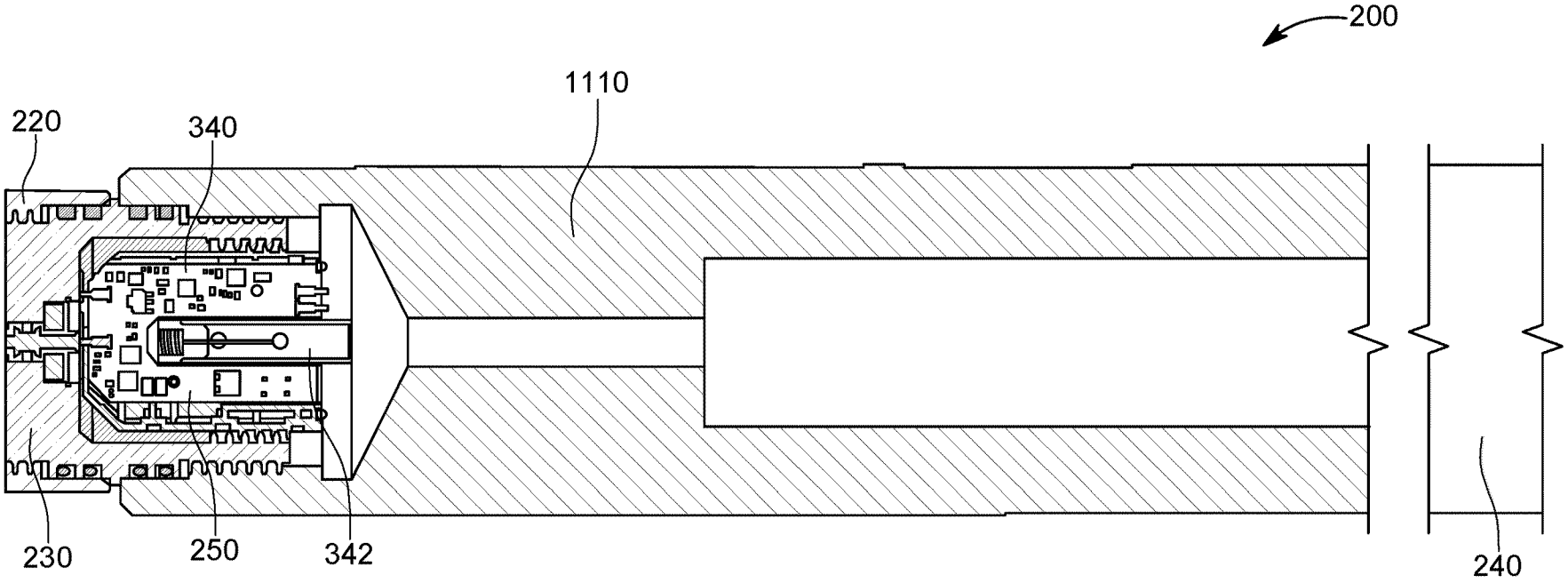
FIG. 11 illustrates another possible connection between the interchangeable module and a setting tool.

FIG. 11 shows an embodiment in which the plug shoot adaptor 840, which is shown in FIG. 9, has been merged with the top sub 241 of the setting tool 240, which is also shown in FIG. 9, to form a single adaptor device 1110. Thus, in this embodiment, a length L between the last gun cluster 220 and the setting tool 240 is even shorter than in the embodiment of FIG. 9. Also, in this embodiment, the adaptor device 1110 is a single element that directly connects to the tandem sub 230 and the setting tool 240, thus, simplifying the connection between these elements.

Figure 12:
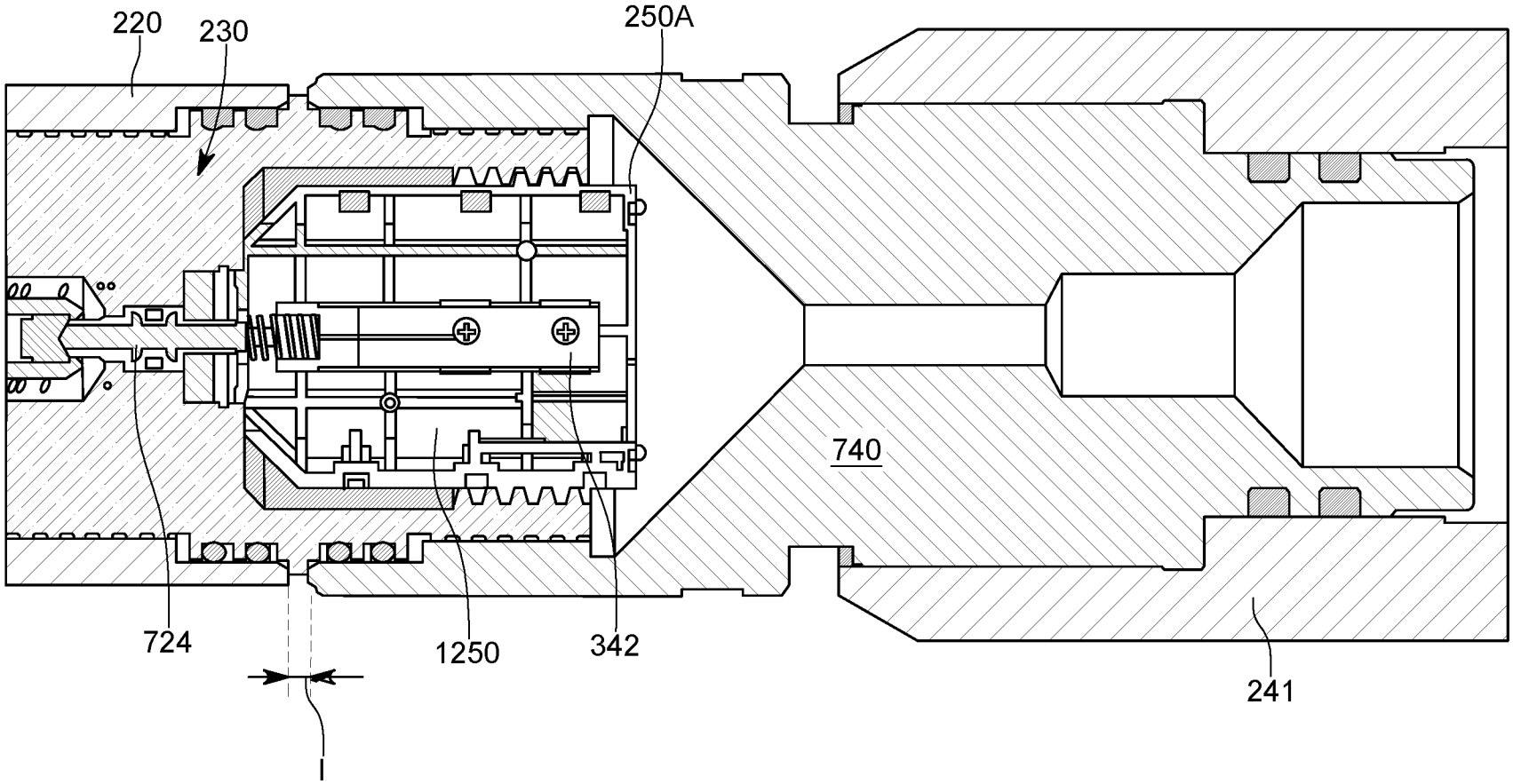
FIG. 12 illustrates a footprint of the tandem sub, when assembled within the integrated perforating gun and setting tool system.

FIG. 12 shows another embodiment in which the module 250 of FIG. 9 is modified to be "simplified" module 1250. Simplified module 1250 is devoid of most electronics that is present in the module of FIGS. 3 and 4. For example, the simplified module 1250 does not include an addressable switch, or any other switch or even a printed circuit board. This is possible because the simplified module is the last module in the chain of modules that are deployed in the integrated gun cluster and setting tool system 200, i.e., the simplified module is located between the last gun cluster and the setting tool. Thus, the simplified module has no pins facing the setting tool. The simplified module has only two contacts, a ground and the bottom feedthrough 724 for igniting the initiating device 342, which is an ignitor in this case.

Figure 13:
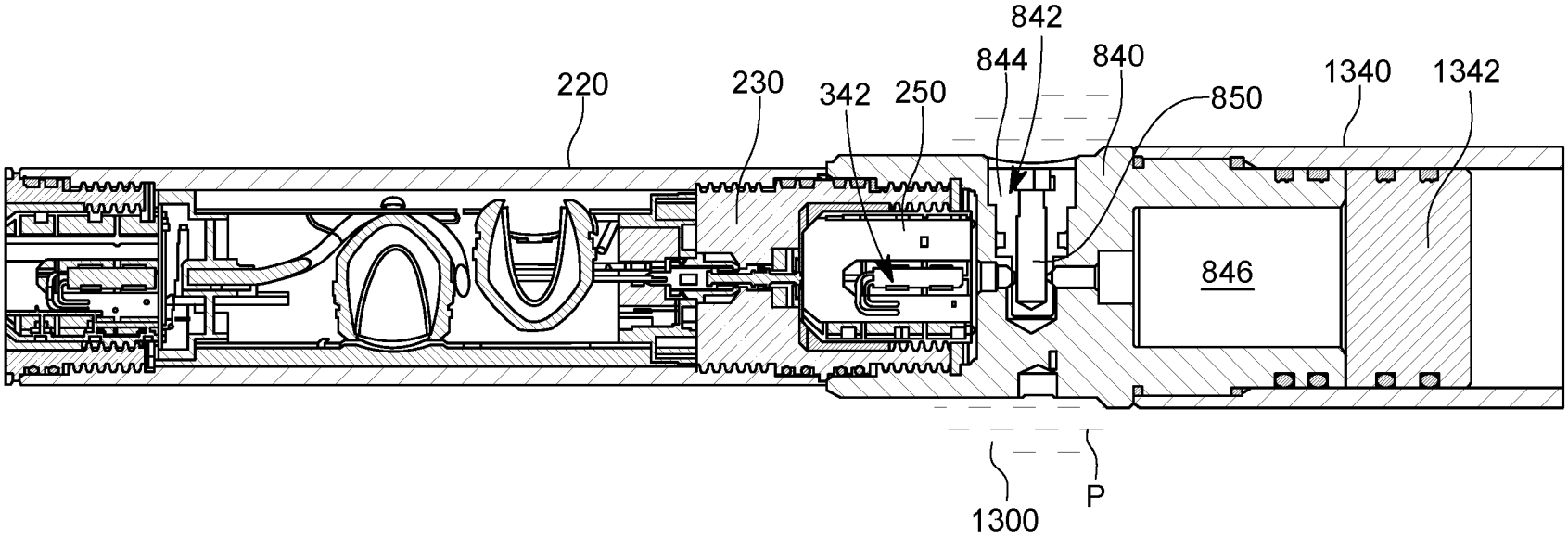
FIG. 13 illustrates the integrated perforating gun and setting tool system having a hydraulically actuated setting tool.

In still another embodiment, as illustrated in FIG. 13, the module 250 and the corresponding tandem sub 230 are connecting the last gun cluster 220 to the plug shoot adapter 840. However, a setting tool 1340, which is attached to the plug shoot adapter 840, is a hydrostatically actuated setting tool as disclosed, for example, in U.S. patent application Ser. No. 16/193,030, entitled "Hydraulically Activated Setting Tool and Method," the entire content of which is incorporated herein by reference. The hydraulically activated setting tool 1340 has no power charge. This setting tool is activated by the hydrostatic pressure P of a fluid 1300 that is present around the outside of the setting tool. The adapter 840 has a port 842 formed in its body 844, as illustrated in FIG. 13. A pin 850 is placed inside the port 842 to prevent the fluid 1300 from entering an interior bore 846 of the adapter 840. When the initiating device 342 is activated, which in this case is a specific detonator, its shock wave breaks the pin 850, and establishes fluid communication between the outside of the adapter 840 and the bore 846. The fluid 1300 enters inside the bore 846 and pressurizes a piston 1342, whose movement activates the setting tool 1340. Those skilled in the art would understand that the module 250 and its associated initiating device may be used for other purposes.

Figure 14A:
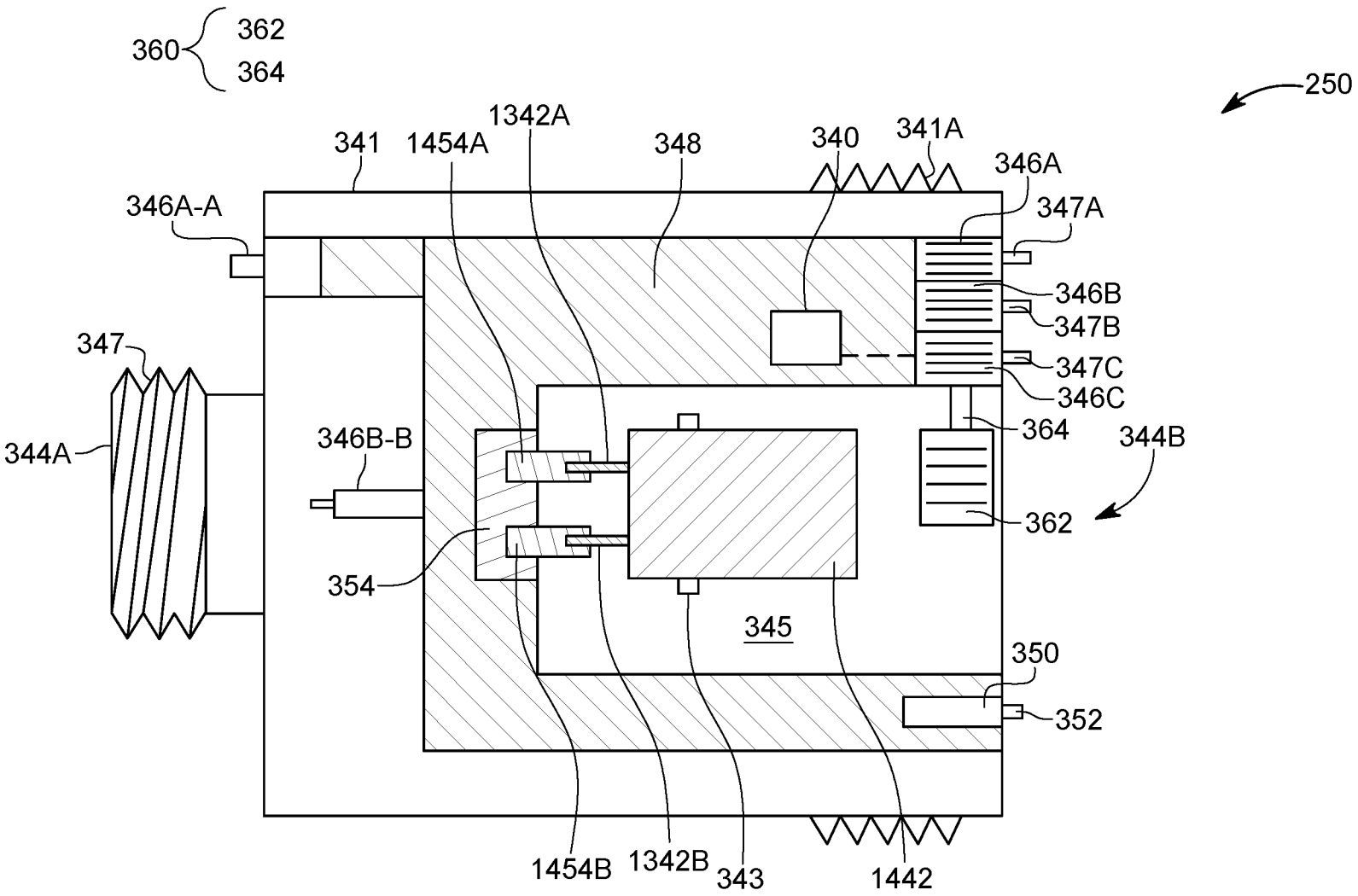
FIG. 14A illustrates an interchangeable module having a wireless detonator and FIG. 14B illustrates an interchangeable module having no external threads.
Figure 14B:
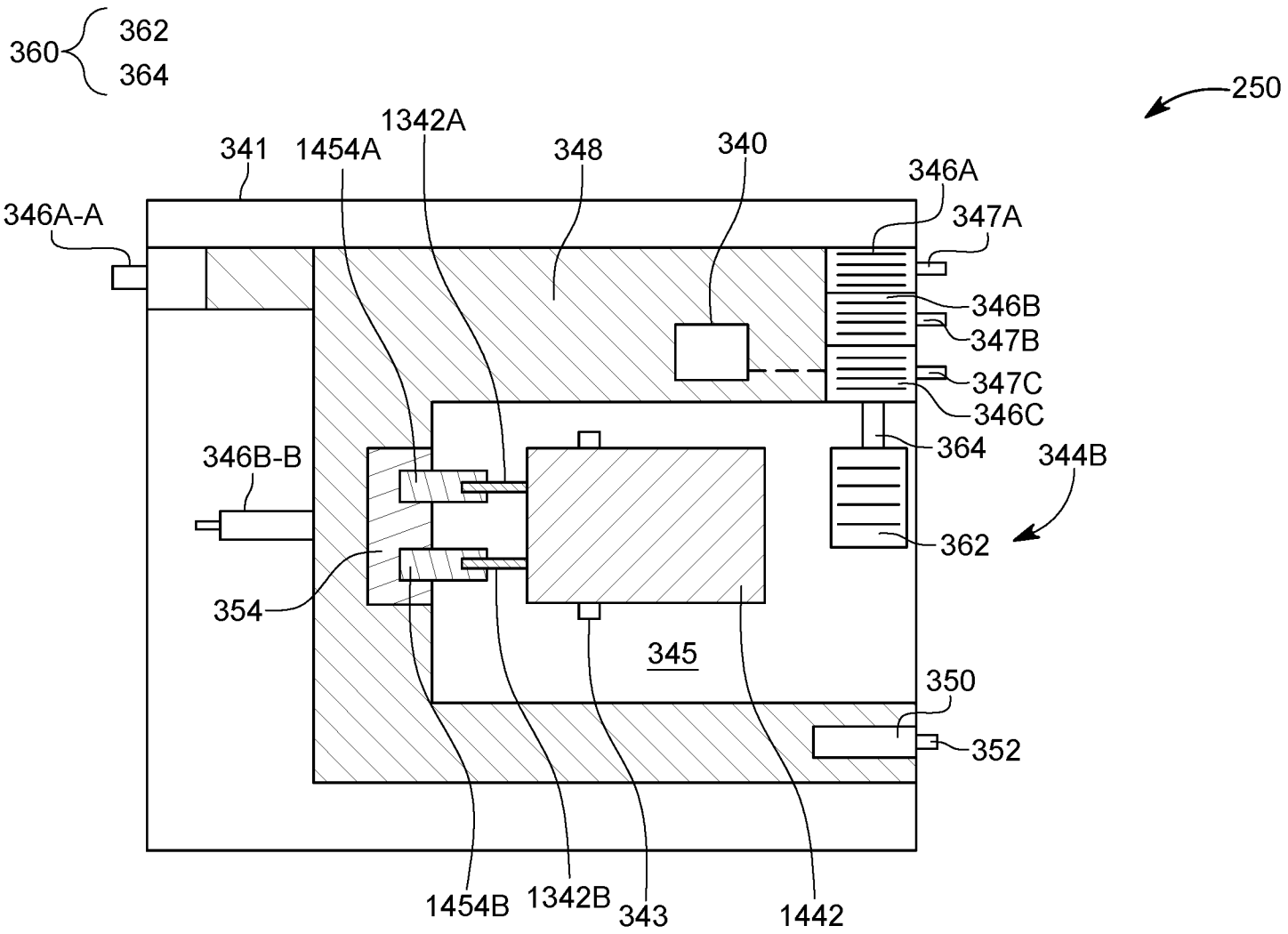

The module 250 illustrated in FIG. 3 is configured so that the initiating device 342 is wired (through leads 342A and 342B) to the circuit board 348 and to the addressable switch 340. However, it is possible, as illustrated in FIG. 14A, to have the initiating device 1442 manufactured without any leads, but only with two contacts 1342A and 13426. These contacts are configured to simply touch corresponding contacts 1454A and 1454B, formed on the wire connection unit 354 of the circuit board 348, so that no wires or leads are necessary for electrically connecting the initiating device 1442 to the circuit board. In this way, the module 1450 shown in FIG. 14A is actually wire free, i.e., it connects in a wireless manner to a gun cluster and a setting tool, but also to a corresponding initiating device 1442. The wire connection unit 354 may be omitted in one embodiment, and the contacts 1454A and 1454B may be attached directly to the circuit board 348. In one embodiment, the two contacts 1342A and 1342B extend outside the initiating device 1442 and are configured to mate, in a female to male arrangement, to the corresponding contacts 1454A and 1454B of the printed circuit board. Other methods for connecting the initiating device 1342 to the circuit board 348 may be used as long as no wires are involved. In one embodiment, as illustrated in FIG. 14B, the module 250 may be configured to have no threads on the outside. Thus, for this embodiment, threads 347 and 341A are omitted. Even more, the structure at the end 344A is also omitted. The module 250 can be attached to an inside of a corresponding sub or perforating gun by snapping or latching it in place. Note that for this embodiment, the detonator may also be attached with wires to the circuit board, as illustrated in FIG. 3.

Figure 15:
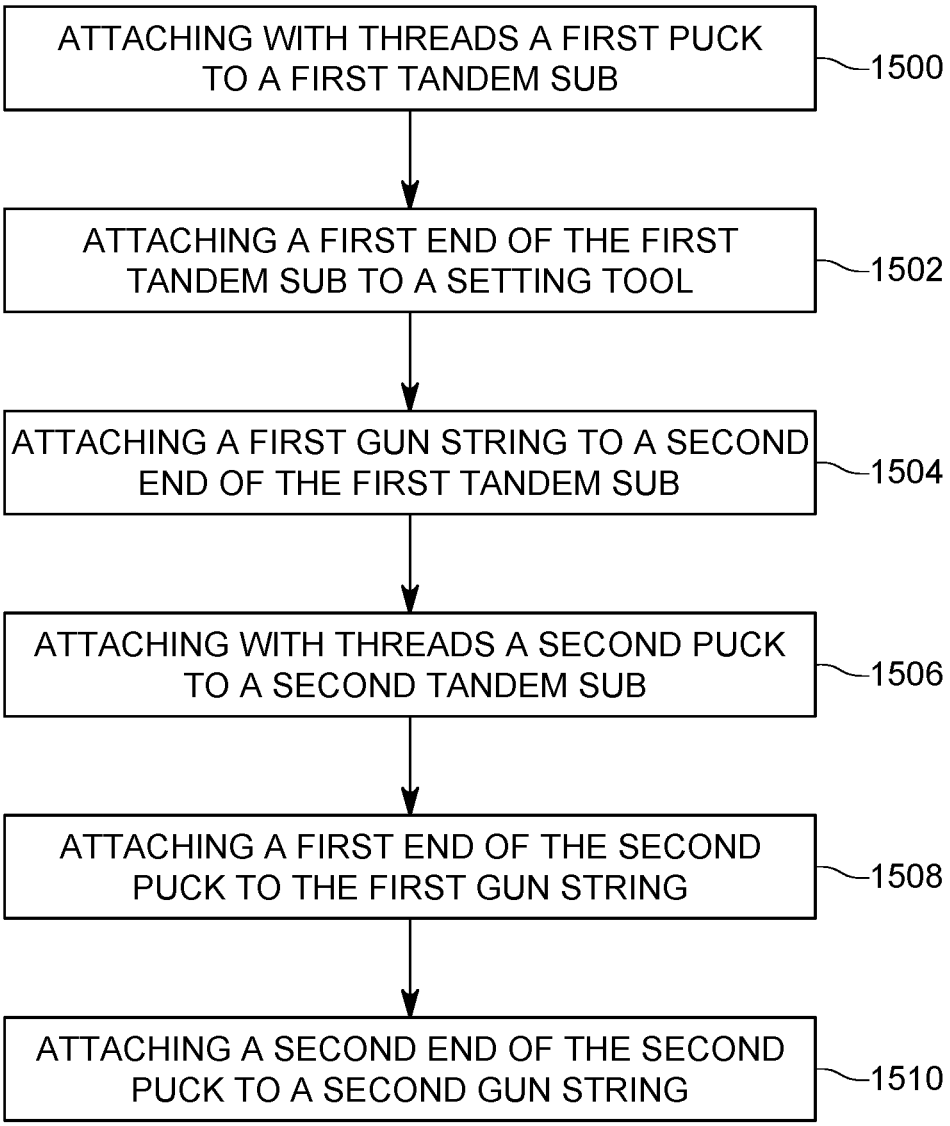
FIG. 15 is a flowchart of a method for assembling an integrated perforating gun and setting tool system.

A method for assembling an integrated perforating gun cluster and setting tool system 200 is now discussed with regard to FIG. 15. The method includes a step 1500 of attaching with threads a first module 250 to a first tandem sub 230, a step 1502 of attaching a first end of the first tandem sub 230 to a setting tool 240, a step 1504 of attaching a first gun cluster 220 to a second end of the first tandem sub 230, a step 1506 of attaching with threads a second module 250 to a second tandem sub 230, a step 1508 of attaching a first end of the second module 250 to the first gun cluster 220, and a step 1510 of attaching a second end of the second module 250 to a second gun cluster 220, where the first module is identical to the second module. In one application, the first tandem sub is identical to the second tandem sub.

The method may further include electrically connecting each of the first and second modules to a corresponding initiating device, which is detachably attached to each of the first and second modules, and/or selecting the initiating device to be an ignitor for the first module and a detonator for the second module. In one application, each of the first and second modules includes a body 341 having first external threads 341A, an addressable switch 348 located inside the body 341, and a wire connection 354 located inside the body and configured to electrically connect to an initiating device 342. In one embodiment, the body is shaped as a box.

The method may further includes forming the first external threads only on two opposite faces of the body. The two opposite faces of the body correspond to a width of the box, a length of the box corresponds to a length of the two gun clusters, and a height of the box corresponds to an internal diameter of a tandem sub in which the module is located. The method may also include forming second external threads at an end of the body. In one application, a diameter of the second external threads is smaller than a diameter of the first external threads. The method may further include configuring the first and second external threads to mate with corresponding threads formed in a corresponding tandem sub.

While the various features illustrated above have been discussed in the context of the oil and gas industry, those skilled in the art would understand that the novel features are applicable to devices in any field. For example, the rotatable multipin connection between the module and the contact end plate mechanism utilizing the printed circuit board as an electromechanical connection may be used in the electronics field. The spring loading of the pins 347A to 347C may account for tolerances in makeup and add practicality to any two elements that need to be electrically connected. Furthermore, the cost of such PCB connector is much below other multipin designs.

The disclosed embodiments provide methods and systems for assembling guns strings and a setting tool to form an integrated perforating gun and setting tool system, by using a same tandem sub between any two adjacent gun clusters and a gun cluster and the setting tool. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. An interchangeable module configured to be used in an integrated perforating gun and setting tool system, the interchangeable module comprising:

a body having first external threads;

an addressable switch located inside the body, on a circuit board; and a connection unit located inside the body, on the circuit board, and configured to electrically connect to an initiating device, wherein the interchangeable module is configured to be used (1) between a first gun cluster and a second gun cluster and (2) between a distal gun cluster and a setting tool.

2. The interchangeable module of claim 1, further comprising:

the initiating device, which is detachably attached to the body.

3. The interchangeable module of claim 2, wherein the initiating device is a detonator when the module is located between the first gun cluster and the second gun cluster and an ignitor when the module is located between the distal gun cluster and the setting tool.

4. The interchangeable module of claim 2, wherein the initiating device is selected based on whether the module is placed between the first and second gun clusters or between the distal gun cluster and the setting tool.

5. The interchangeable module of claim 1, wherein the first external threads are formed on the body and the body is shaped as a box.

6. The interchangeable module of claim 5, wherein the first external threads are formed only on two opposite faces of the body.

7. The interchangeable module of claim 6, wherein the two opposite faces of the body correspond to a width of the box, a length of the box corresponds to a length of the first and second gun clusters, and a height of the box corresponds to an internal diameter of a tandem sub in which the module is located.

8. The interchangeable module of claim 5, further comprising:

second external threads formed at an end of the body.

9. The interchangeable module of claim 8, wherein a diameter of the second external threads is smaller than a diameter of the first external threads.

10. The interchangeable module of claim 1, wherein the connection unit is wired to the initiating device.

11. A tandem sub configured to be used in an integrated perforating gun and setting tool system, the tandem sub comprising:

a cylindrical body having a bore;

an interchangeable module having first threads that are threaded into the bore of the cylindrical body; and an initiating device located inside the interchangeable module, wherein the cylindrical body is configured to attach with either end to a gun cluster and a setting tool of the integrated perforating gun and setting tool system, and wherein the initiating device is configured to initiate either the gun cluster or the setting tool.

12. The tandem sub of claim 11, wherein the cylindrical body has three regions, a first region that engages the gun cluster, a second region that engages another gun cluster, and a third region that is sandwiched between the first and second regions, and wherein the third region is the only region exposed to the outside when the tandem sub is fully engaged to the gun cluster and the another gun cluster, and wherein a length of the third region is smaller than 5 cm.

13. The tandem sub of claim 12, wherein the length of the third region is smaller than 1 cm.

14. The tandem sub of claim 11, wherein the interchangeable module comprises:

a body having the first external threads;

an addressable switch located inside the body; and the initiating device is located inside the body and electrically connected to the addressable switch.

15. The tandem sub of claim 11, wherein the initiating device is detachably attached to the interchangeable module.

16. The tandem sub of claim 11, wherein the initiating device is a detonator when the module is located between the gun cluster and another gun cluster, and an ignitor when the module is located between the gun cluster and the setting tool.

17. The tandem sub of claim 11, wherein the initiating device is selected based on whether the module is placed between the gun cluster and another gun cluster or between the gun cluster and the setting tool.

18. The tandem sub of claim 11, wherein the first external threads are formed on a body of the interchangeable module and the body is shaped as a box.

19. The tandem sub of claim 18, wherein the first external threads are formed only on two opposite faces of the body.

20. The tandem sub of claim 19, wherein the two opposite faces of the body correspond to a width of the box, a length of the box corresponds to a length of the gun cluster, and a height of the box corresponds to an internal diameter of the bore.

21. The tandem sub of claim 18, wherein the interchangeable module further comprises:

second external threads formed at an end of the body.

22. A method for assembling an integrated perforating gun and setting tool system, the method comprising:

attaching with threads a first module having a first addressable switch, to a first tandem sub;

attaching a first end of the first tandem sub to a setting tool;

attaching a first gun cluster to a second end of the first tandem sub;

attaching with threads a second module having a second addressable switch, to a second tandem sub;

attaching a first end of the second module to the first gun cluster; and attaching a second end of the second module to a second gun cluster, wherein the first module is identical to the second module.

23. The method of claim 22, wherein the first tandem sub is identical to the second tandem sub.

24. The method of claim 22, further comprising:

electrically connecting each of the first and second modules to a corresponding initiating device, which is detachably attached to each of the first and second modules.

25. The method of claim 24, further comprising:

selecting the initiating device to be an ignitor for the first module and a detonator for the second module.

26. The method of claim 22, wherein each of the first and second modules includes:

a body having first external threads;

an addressable switch located inside the body; and a connection located inside the body and configured to electrically connect to an initiating device.

27. A module configured to be used in an integrated perforating gun and setting tool system, the module comprising:

a body housing a circuit board;

an addressable switch located on the circuit board, inside the body; and an ignitor located inside the body and electrically connected to the addressable switch, wherein the ignitor is surrounded by the circuit board.

28. The module of claim 27, wherein the body has external threads.

29. The module of claim 27, wherein the external threads are formed on the body and the body is shaped as a box.

30. The module of claim 29, wherein the external threads are formed only on two opposite faces of the body.

31. The module of claim 30, wherein the two opposite faces of the body correspond to a width of the box, a length of the box corresponds to a length of a setting tool, and a height of the box corresponds to an internal diameter of a tandem sub in which the module is located.

32. The module of claim 27, wherein the body is configured to connect a gun cluster to a setting tool.

* * * * *